US008503895B2

(12) United States Patent
Hirai

(10) Patent No.: US 8,503,895 B2
(45) Date of Patent: Aug. 6, 2013

(54) IMAGE FORMING APPARATUS CAPABLE OF STABLY CONTROLLING IMAGE DENSITY

(75) Inventor: Shuji Hirai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 192 days.

(21) Appl. No.: 13/051,420

(22) Filed: Mar. 18, 2011

(65) Prior Publication Data

US 2011/0229171 A1 Sep. 22, 2011

(30) Foreign Application Priority Data

Mar. 18, 2010 (JP) ..... 2010-063278
May 11, 2010 (JP) ..... 2010-109134

(51) Int. Cl.
*G03G 15/00* (2006.01)

(52) U.S. Cl.
USPC ..... 399/49; 399/299

(58) Field of Classification Search
USPC ..... 399/49
See application file for complete search history.

(56) References Cited

U.S. PATENT DOCUMENTS 6,975,338 B2 12/2005 Hirai et al.
7,151,901 B2 12/2006 Hirai
7,193,642 B2 3/2007 Hirai et al.
7,343,126 B2 3/2008 Miyawaki et al.
7,359,660 B2 4/2008 Nakazato et al.
7,693,466 B2 4/2010 Miyawaki et al.
7,751,741 B2 7/2010 Hirai
2008/0075476 A1 3/2008 Nakazato et al.
2008/0199193 A1* 8/2008 Nakazato et al. ..... 399/49
2008/0205923 A1 8/2008 Takeuchi et al.
2008/0232832 A1* 9/2008 Itoh et al. ..... 399/34
2008/0253793 A1 10/2008 Ishibashi et al.
2009/0110413 A1 4/2009 Takeuchi et al.

(Continued)

FOREIGN PATENT DOCUMENTS

JP 2001-34027 2/2001
JP 2006-234862 9/2006

(Continued)

OTHER PUBLICATIONS

U.S. Appl. No. 12/875,718, filed Sep. 3, 2010, Satoshi Kaneko, et al.

*Primary Examiner* — Clayton E Laballe
*Assistant Examiner* — Jas Sanghera
(74) *Attorney, Agent, or Firm* — Oblon, Spivak, McClelland, Maier & Neustadt, L.L.P.

(57) ABSTRACT

An image forming apparatus includes plural toner adhered amount detectors that detect an amount of toner particles adhered to the toner image on the image bearer and an image density controller to form a gradation pattern by sequentially arranging plural toner patches in the sub-scanning direction on the image bearer from the least toner adhered amount patch. These toner patches bear a different amount of toner particles from each other. The plural toner patches are detected by the plural toner adhered amount detectors, and the image density controller adjusts an image formation condition for the image formation device based on detection values thereof. These toner adhered amount detectors are symmetrically aligned in a main scanning direction above the image bearer. The image density controller forms the plural toner patches being staggered at different positions on the image bearer, facing these toner adhered amount detectors, respectively.

9 Claims, 9 Drawing Sheets

U.S. PATENT DOCUMENTS

| | | | | |
|---|---|---|---|---|
| 2009/0208233 | A1* | 8/2009 | Hirai | 399/60 |
| 2009/0279907 | A1 | 11/2009 | Tanaka et al. | |
| 2009/0324267 | A1 | 12/2009 | Yoshida et al. | |
| 2010/0033743 | A1 | 2/2010 | Hirai | |
| 2010/0111547 | A1 | 5/2010 | Kawamoto et al. | |
| 2011/0058823 | A1 | 3/2011 | Hirai | |

FOREIGN PATENT DOCUMENTS

| | | |
|---|---|---|
| JP | 2008-96478 | 4/2008 |
| JP | 2008-139592 | 6/2008 |
| JP | 4456828 | 2/2010 |

* cited by examiner

IMAGE FORMING APPARATUS CAPABLE OF STABLY CONTROLLING IMAGE DENSITY

CROSS REFERENCE TO RELATED APPLICATIONS

This application claims priority pursuant to 35 USC §119 to Japanese Patent Application Nos. 2010-109134 and 2010-063278, filed on May 11, 2010 and Mar. 18, 2010, respectively, the entire contents of which are hereby incorporated by reference herein.

BACKGROUND OF THE INVENTION

1. Field of the Invention

The present invention relates to an image forming apparatus capable of stably controlling image density regardless of changes in various conditions.

2. Description of the Background Art

In an image forming apparatus, such as a copier, a laser beam printer, etc., using an electro photographic system, image density is stabilized at all times as described in Japanese Patent Application Laid Open No. 2004-354623 (JP-2004-354623-A). Specifically, image density is controlled such that a gradation pattern is initially formed including multiple toner patches on an image bearer, such as a photoconductor, etc., under different image forming conditions (e.g. developing potentials) so that an amount of toner particles adhered to the respective patches becomes different from each other. Subsequently, an optical sensor serving as an adhered toner amount detector detects each of the toner patches, and the amounts of toner adhered thereto are calculated based on detected values using a predetermined adhered amount calculating algorithm. Subsequently, a linear equation ($y=ax+b$) is obtained based on a relation between the amounts of adhered toner particles and the image forming conditions of the toner patches. Then, development $\gamma$ serving as an index value indicating developing performance (the slope of a line plotted against the developing potential is represented by a horizontal axis and the amount of adhered toner particles is represented by a vertical axis) and a development start voltage Vk (the intercept ($-b/a$) of the horizontal axis) are found. Based on the thus found development $\gamma$ and development start voltage Vk, image forming conditions, such as LD power, a charging bias, a developing bias, etc., are adjusted so that the developing potential can adhere an adequate amount of toner particles.

In a color image forming apparatus which forms a color image using toner particles of four colors of Y, M, C and K, gradation patterns are formed for respective colors. In such a situation, when only one optical sensor is used, the gradation patterns of these colors are accordingly formed aligned in a sub-scanning direction resulting in slow image density control. To resolve the problem, Japanese Patent Application Laid Open No. 2006-234862 (JP-2006-234862-A) discloses an image forming apparatus that employs a so-called tandem system, in which Y, M, C and K image forming stations each having a photoconductor are arranged in parallel to each other along a traveling direction of an intermediate transfer belt serving as an image bearer. Subsequently, the color image forming apparatus detects the gradation patterns of respective colors with Yellow, Magenta, Cyan, and Black optical sensors aligned in the main scanning direction facing the intermediate transfer belt. Specifically, the gradation patterns of respective colors are formed on the intermediate transfer belt aligned in the main scanning direction to be detected by multiple optical sensors corresponding to an applicable color. Consequently, it is possible to decrease the time for the image density control.

However, density fluctuates in the main scanning direction in the image forming apparatus due to various factors, such as developing gap fluctuation where the developing gap gradually increases from one to the other ends of the photoconductor in its axial direction, etc. Such density fluctuation causes the following problems. When the density fluctuates in the main scanning direction and is darker at a section on the intermediate transfer belt where a gradation pattern is formed with a certain color, than the other sections, the gradation pattern of the certain color increasingly attracts toner particles due to the fluctuation in the density. As a result, when image density is controlled based on the detection result of the above-described gradation pattern, although an image formed under the thus executed image density control achieves a target density at the section forming the gradation pattern, density of the other sections become thinner than the target. Accordingly, an image of the color becomes thinner as a whole after the image density control.

By contrast, when the density fluctuates in the main scanning direction and is darker at the other section on the intermediate transfer belt than the section where a gradation pattern is formed with a certain color, the gradation pattern of the certain color attracts fewer toner particles due to the fluctuation in the density. Therefore, when the image density is controlled based on the detection result of this gradation pattern, although a section of an image where the gradation pattern is formed achieves a target density after the image density control, the other section is darker than the target. As a result, an image of the color becomes darker as a whole after the image density control.

According to Japanese Patent Application Laid Open No. 2008-139592 (JP-2008-139592-A), first and second optical sensors are arranged on both sides of an intermediate transfer belt, and a gradation pattern is formed and detected by differentially. Subsequently, the image forming apparatus averages the previous and current detection results and adjusts image density based on the average value thus obtained. Accordingly, it is possible to prevent the image from becoming thinner or darker as a whole after the image density control. Because, even though both more and less than the average of toner adhering amounts are obtained by both side optical sensors due to fluctuation in the density in the main scanning direction but are averaged.

However, according to the image forming apparatus of JP-2008-139592-A, density sometimes fluctuates in the main scanning direction between previous and current image density control operations, and as a result, an accurate the average is rarely obtained. Accordingly, the image is not sufficiently prevented from becoming thinner or darker as a whole after image density control. In addition, since detection results reflects problems other than the fluctuation in density in the main scanning direction but are averaged at the same time, precision control of image density remains unattained.

SUMMARY OF THE INVENTION

Accordingly, an object of the present invention is to provide a new and novel image forming apparatus that includes an image bearer to bear an image, an image formation device to form a toner image on the image bearer, and multiple toner adhered amount detectors each to detect an amount of toner particles adhered to the toner image on the image bearer. An image density controller is provided to form multiple gradation patterns each including multiple toner patches sequentially arranged in the sub-scanning direction on the image bearer from the least toner adhered amount patch. These toner patches bear a different amount of toner particles from each other. These toner patches are detected by the multiple toner adhered amount detectors and the image density controller adjusts an image formation condition for the image formation device based on detection values thereof. The toner adhered amount detectors are symmetrically aligned in a main scanning direction above the image bearer. The image density controller forms the multiple toner patches being staggered at different positions on the image bearer, facing the multiple toner adhered amount detectors, respectively.

In another aspect, the two toner adhered amount detectors are optical detectors.

In yet another aspect, a total number of the multiple toner patches is a multiple of a number of the multiple toner adhered amount detectors and a prescribed even number. The image density controller divides the total number of the toner patches into multiple groups each having prescribed multiple numbers of toner patches obtained by multiplying the number of the multiple toner adhered amount detectors by a prescribed number. The multiple toner patches are sequentially arranged at different positions in both the main and sub-scanning directions being staggered having a first inclination in an odd number group. The multiple toner patches face the respective of the multiple toner adhered amount detectors. The multiple toner patches are sequentially arranged at different positions in both the main and sub-scanning directions being staggered having a second inclination in the next even number group. The second inclination is symmetric with the first inclination. The multiple toner patches face the respective of the multiple toner adhered amount detectors.

In yet another aspect, the odd and even number groups are sequentially formed in the sub-scanning direction, and the end of the first inclination corresponds to the start of the second inclination.

In yet another aspect, the toner particles are increasingly adhered to the multiple toner patches in the even and odd number groups in both the main and sub-scanning directions.

In yet another aspect, the image density controller determines the total number of toner patches, and a manner of staggering of the multiple toner patches in the main and sub-scanning directions based on the number of the multiple toner adhered amount detectors.

In yet another aspect, the image density controller changes the manner of staggering of the multiple toner patches when one of the multiple toner adhered amount detectors becomes inoperable.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
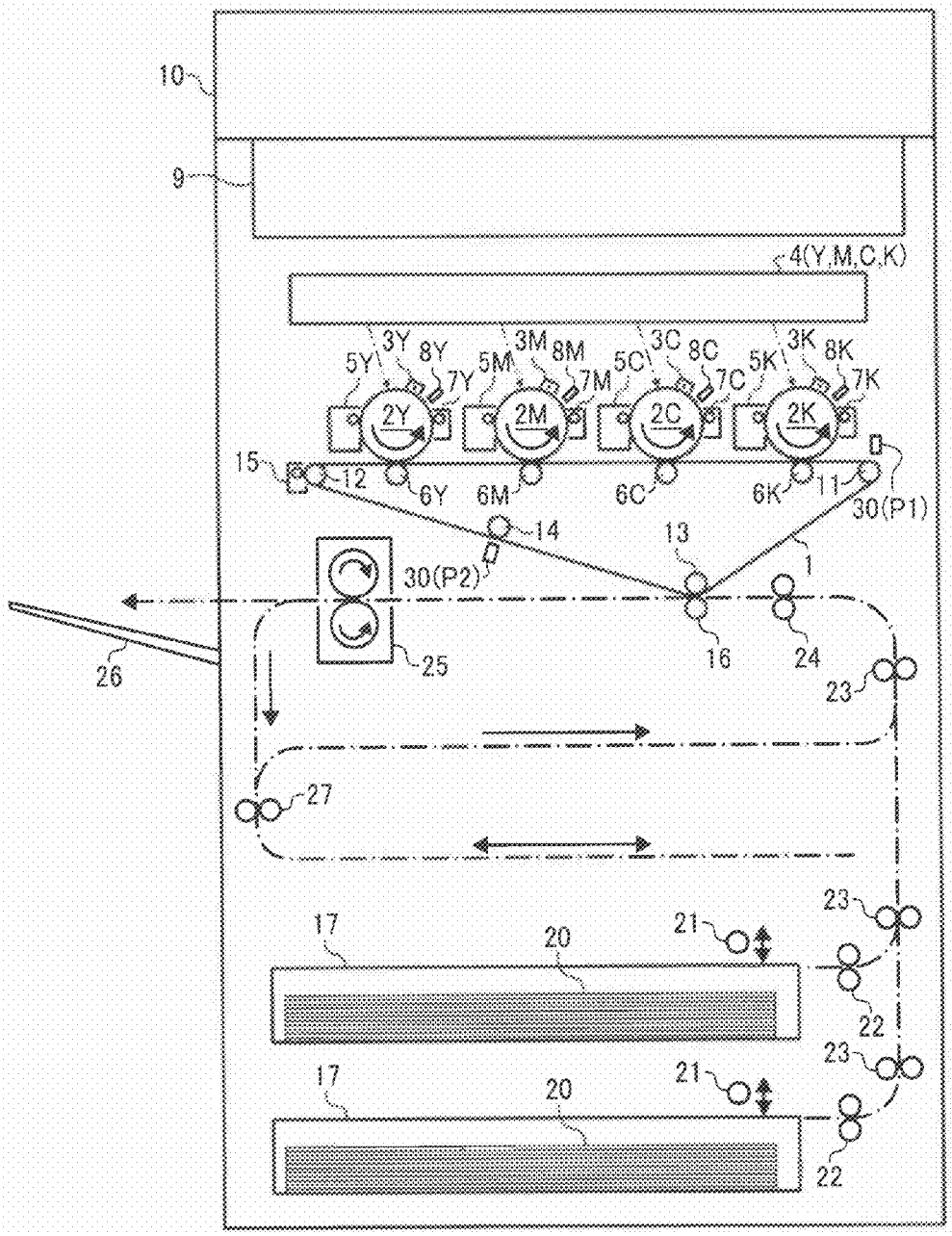
FIG. 1 is a schematic diagram illustrating an image forming apparatus according to one embodiment of the present invention.

Referring now to the drawings, wherein like reference numerals designate identical or corresponding parts throughout several views, in particular in FIG. 1, an image forming apparatus according to one embodiment of the present embodiment is described. Although the present invention employs a full-color copier of a quadruple tandem type intermediate transfer system, the present invention is not limited thereto and the system may be a full-color copier employing a quadruple tandem type direct transfer system or a single drum type intermediate transfer system, or a monochrome copier of a single drum type direct transfer system. Along the stretched surface of an intermediate transfer belt 1 serving as an image bearer and an intermediate transfer body, photoconductive drums 2Y, 2M, 2C and 2K which are image bearers are disposed in parallel.

The reference symbols Y, M, C and K assigned to reference numerals indicate yellow, magenta, cyan and black, respectively. An image forming station of yellow will be described as a representative. An electrifying charger 3 as an electrifying device, a writing unit 4Y, a developing unit 5Y, a primary transfer roller 6Y as a primary transferring device, a photoconductive cleaner 7Y and a quenching lamp 8Y are arranged in this order in the rotation direction of the photoconductive drum 2Y therearound. The same applies to image forming stations of other colors. Above the writing unit 4, a scanner 9 and ADF (Automatic Document Feeder) 10 may be provided.

The intermediate transfer belt 1 is rotatable supported by multiple rollers 11, 12 and 13, and an intermediate transfer belt cleaner 15 as a cleaner is provided in a section opposing the roller 12. In the section opposing the roller 13, a secondary transfer roller 16 as a transferring device is provided. In a lower part of a device main body, multiple paper feed trays 17 are provided, and printing sheets 20 of recording media accommodated in these trays is fed by pick-up rollers 21 and feed rollers 22, conveyed by pair of convey rollers 23 and is sent to a secondary transferring unit at a predetermined timing by a pair of resist rollers 24. A fuser 25 of fusing means is provided downstream of a sheet conveying direction of the secondary transferring unit. In FIG. 1, reference numeral 26 denotes a discharge tray and 27 denotes a pair of switch back rollers.

As shown in FIG. 1, a series of image forming operations will be described. When a print start command is inputted, each roller starts rotating at a predetermined timing near the photoconductive drums, near the intermediate transfer belt and on the sheet feeding conveying path, a printing sheet starts being fed from the feed trays in the lower part. Whereas, the surface of each photoconductive drum 2 is charged to have a uniform potential by the electrifying charger 3, and its surface is exposed according to image data by writing light radiated from the writing unit 4.

A potential pattern after the exposure is referred to as an electrostatic latent image. The photoconductive drum 2 which carries this electrostatic latent image on its surface receives a supply of toner from the developing unit 5, so that the carried electrostatic latent image is developed to a specific color. In FIG. 1, there exist photoconductive drums 2 for four colors, and therefore toner images of yellow, magenta, cyan and black (the order of colors varies depending on the system) are developed on respective photoconductive drums.

At the contact point with the intermediate transfer belt 1, the toner image developed on each photoconductive drum 2 is transferred onto the intermediate transfer belt 1 by a primary transfer bias applied to the primary transfer roller 6 disposed opposing the photoconductive drum, and pressuring force. By repeating this primary transferring operation for four colors while adjusting a timing of the primary transferring operation, a full-color toner image is formed on the intermediate transfer belt 1.

In the secondary transfer roller, the full-color toner image formed on the intermediate transfer belt 1 is transferred onto the printing sheet 20 which is conveyed at an adjusted timing by a pair of resist rollers 24. At this time, a secondary transfer is performed by a secondary transfer bias applied to the secondary transfer roller 16, and pressuring force. The printing sheet 20 to which the full-color toner image is transferred passes through the fuser 25, so that the toner image carried on the surface of the printing sheet 20 is heated and fused.

When a single-side printing is executed, the printing sheet 20 is linearly conveyed as is to the discharge tray 26 and, when a double-side printing is executed, the conveying direction of the printing sheet 20 is changed downward and is conveyed to a sheet reversing unit. Reaching the sheet reversing unit, the conveying direction of the printing sheet 20 is reversed by a pair of switch back rollers 27, and the rear end of the printing sheet 20 is sent out first from the sheet reversing unit. This is referred to as a switch back operation, and this operation can reverse the two sides of the printing sheet. The printing sheet with its two sides reversed does not return in the fuser direction, and merges with an original paper feed route passing a sheet re-feed conveying path. Then, a toner image is transferred onto the printing sheet in the same manner as first side printing, and the printing sheet is discharged passing the fuser 25 as a double-sided printing operation. Further, the operation of each unit till the end is now described. The photoconductive drum 2 having passed the primary transferring unit carries a primary transfer remaining toner on its surface, and the primary transfer remaining toner is removed by a photoconductive cleaner 7 which may be formed including a blade and a brush. Then, the surface of the photoconductive drum 2 is neutralized by the quenching lamp 8 to prepare for charging of the next image.

Further, although the intermediate transfer belt 1 having passed the secondary transferring unit carries a secondary transfer remaining toner on its surface, this post secondary transfer remaining toner is also removed by an intermediate transfer belt cleaner 15 including a blade and a brush to prepare for transferring of the next toner image. By repeating these operations, single-side or double-side printings are performed.

At the position (the position before secondary transfer) opposing the roller 11 and outside the intermediate transfer belt 1, an optical sensor unit 30 which has optical sensors of multiple adhered toner amount detectors is arranged. The optical sensor unit 30 can also be arranged downstream of the secondary transferring unit (position after secondary transfer). When the optical sensor unit 30 is arranged downstream of the secondary transferring unit, a roller 14 for preventing vibration of the intermediate transfer belt 1 is provided inside thereof. In this way, there exist two possible positions to dispose the optical sensor unit 30 as described above. Specifically, one is a position P1 before secondary transfer. The position P1 is usually employed if there does not exist a machine layout restriction, in which a toner pattern on the intermediate transfer belt 1 is detected, before the secondary transfer process. This is because the gradation pattern described later can be detected immediately after its formation without a long waiting time while avoiding necessity of enabling the gradation pattern to pass through the secondary transferring unit.

However, there exist many types of machines in which a secondary transfer position is provided immediately after the image forming station of the fourth color (e.g. black), and, in this situation, a sensor is hardly disposed at the position P1 due to space. In such a situation, the optical sensor unit 30 is disposed at the position P2 to operate after secondary transfer, and the gradation pattern formed on the intermediate transfer belt 1 is enabled to pass through the secondary transferring unit and is detected by the optical sensor unit 30. Although the system of enabling the gradation pattern to pass through the secondary transferring unit may be performed by separating the secondary transfer roller 16 or applying a reverse bias to the secondary transfer roller 16, the system is not particularly limited thereto. Thus, when an image forming apparatus employs a quadruple tandem type intermediate transfer system, the optical sensor unit 30 can be positioned at the above-described two positions.

In the image forming apparatus shown in FIG. 1, the photoconductive drum 2, a charger 3, a writing unit 4, a developing unit 5, and a primary transfer roller 6 collectively function as an image forming device, and four image forming apparatuses are provided for four colors of Y, M, C and K, respectively.

Figure 2:
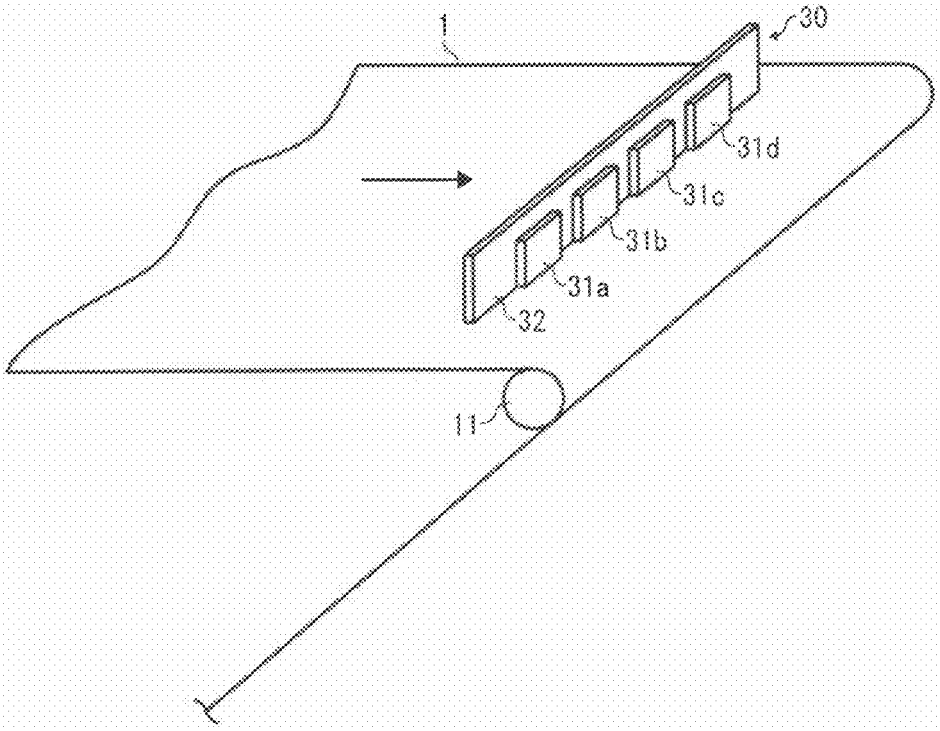
FIG. 2 is a perspective view of a main part showing a condition where a toner image detector is disposed.

FIG. 2 schematically illustrates an arrangement of the optical sensor unit 30 just disposed at the position P1 of FIG. 1. Although the optical sensor unit 30 is a four-head type that mounts optical sensors 31*a*, 31*b*, 31*c* and 31*d* on a sensor substrate 32 as four adhered toner amount detectors in the main scanning direction (i.e., an axial direction of the photoconductive drum 2), which is orthogonal to a printing sheet conveying direction, the number of sets is not particularly limited thereto.

Figure 3:
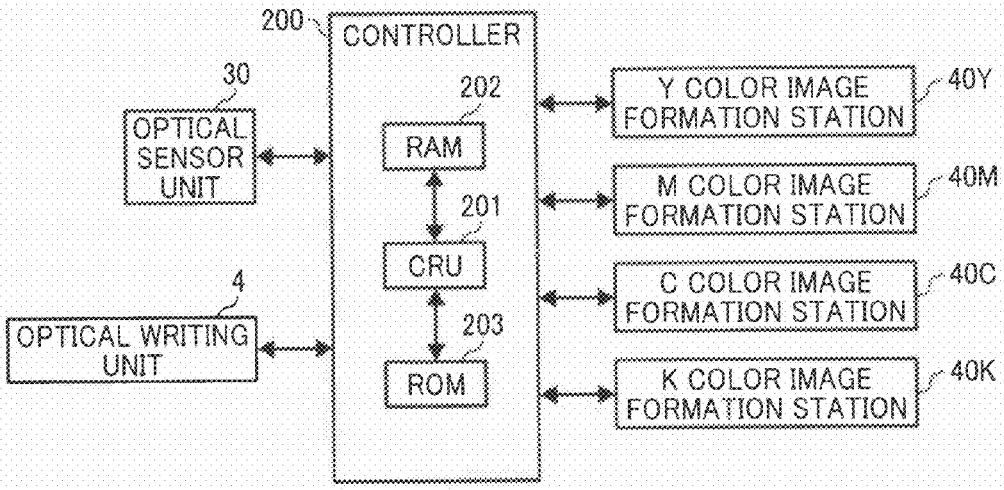
FIG. 3 is a block diagram showing a main part of a control system of a printer.

FIG. 3 is a block diagram showing a main part of a control system of the image forming apparatus. A controller 200 may be formed including a microcomputer, and has a CPU (Central Processing Unit) 201 as a computing device, a RAM (Random Access Memory) 202 of a non-volatile memory as storage, and a ROM (Read Only Memory) 203. This controller 200 is electrically connected to image forming stations 40Y, M, C and K, the writing unit 4, and the optical sensor unit 30. Then, the controller 200 controls these various devices based on control program stored in the RAM 202. The RAM 202 stores output conversion data (conversion table) which is output conversion information used to calculate a toner density (the amount of adhered toner particles) from a detected value of each optical sensor of the optical sensor unit 30, and an output conversion equation (algorithm) as described later.

Further, the controller 200 functions as an image density controller, and executes image density control for optimizing the image density of each color when power is activated or every time when a predetermined number of sheets has been printed. The image density is controlled as described below. Gradation patterns of respective colors are initially automatically formed at positions on the intermediate transfer belt 1 opposing the optical sensors 31*a* to 31*d*. The gradation pattern of each color is formed from about ten toner patches of different image densities from each other. Specifically, values of charge potentials are gradually increased when the gradation pattern of each color is formed on each of the photoconductors 2Y, 2M, 2C and 2K as is different from when a uniform drum charge potential is used in a printing process. Then, multiple patches of electrostatic latent images forming a gradation pattern image are formed on each of the photoconductors 2Y, M, C and K and are developed by each of the Y, M, C and K developing devices 5Y, M, C and K. During this development, gradually increasing values of developing biases are applied to the each of the Y, M, C and K development rollers. Consequently, Y, M, C and K gradation pattern images are formed on the photoconductors 2Y, M, C and K.

Each of the toner patterns formed on the intermediate transfer belt 1 pass through a position opposing the optical sensor unit 30 during endless movement of the intermediate transfer belt 1. In this situation, each of the optical sensors 31*a* to 31*d* receives an intensity of light corresponding to the amount of adhered toner particles per unit area with respect to the toner patch of each of the gradation patterns.

Subsequently, by using adhered amount conversion algorithm and calculating the amount of adhered toner particles in each of toner patches of the toner pattern of each color based on the output voltage of each of the optical sensors 31*a* to 31*d* detecting the toner patches, various image forming conditions are adjusted based on the calculated amount of adhered toner particles. More specifically, a function (y=ax+b) is calculated by applying regression analysis to indicate a linear graph based on a detected amount of adhered toner particles in each of the toner patches and each of the developing potentials applied when each of the toner patches is formed. Further, an adequate developing bias value is calculated by substituting a target value of an image density in this function, and thereby Y, M, C and K developing bias values are specified.

For this purpose, in the memory, an image forming condition data table is stored in which several tens of developing bias values and adequate drum charge potentials respectively corresponding thereto are associated in advance. Specifically, for image forming device of each color, a developing bias value closest to the specified developing bias value and a drum charge potential associated therewith are specified from the image forming condition table. Subsequently, the specified developing bias value and drum charge potential are stored in the memory. Image density control has been described above.

Accordingly, an image having a predetermined density is obtained by controlling image forming conditions to provided the developing bias and drum charge potential stored in the memory and forming an image based thereon.

Figure 4:
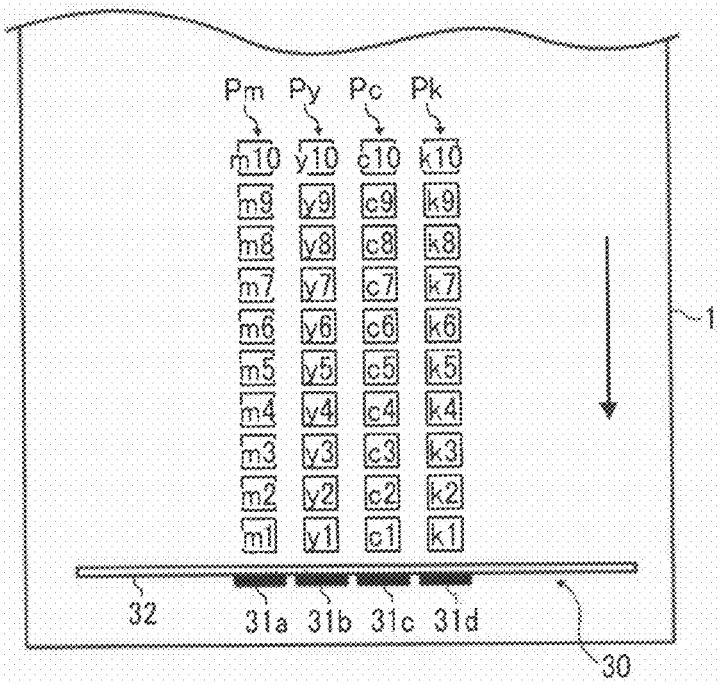
FIG. 4 is a schematic view showing an intermediate transfer belt in a conventional image forming apparatus and a gradation pattern of each color formed on the surface of the intermediate transfer belt.

FIG. 4 is a schematic diagram showing the intermediate transfer belt 1 and gradation patterns Pm, Py, Pc and Pk of each color formed on the surface of the intermediate transfer belt 1 in a conventional image forming apparatus. As shown, the conventional image forming apparatus detects M, Y, C and K gradation patterns Pm, Py, Pc and Pk with respectively different optical sensors. The gradation patterns Pm, Py, Pc and Pk of each color are each formed including ten toner patches of respectively different amounts of adhered toner particles in the same color. Specifically, in FIG. 4, m1, y1, c1, and k1 are toner patches each having the least amount of adhered toner particles, and m10, y10, c10 and k10 are toner patches each having the greatest amount of adhered toner particles. Further, M, Y, C and K gradation patterns Pm, Py, Pc and Pk are aligned and formed in the main scanning direction (i.e., a belt width direction) as shown. With this configuration, it is possible to form gradation patterns and detect toner patches in each of the gradation patterns of each color in parallel, and quickly complete image density control in comparison with a situation where formation and detection of those are performed per color one after another.

However, in the conventional image forming apparatus, when the density of a toner patch fluctuates in the main scanning direction of the intermediate transfer belt 1, image density becomes darker or thinner as a whole after image density control due to the impact of the fluctuation. In general, density fluctuates in the main scanning direction when a developing gap fluctuates as gradually becoming smaller or larger from one to the other ends in the photoconductor axial direction, or when a toner density fluctuates in the developing device by gradually becoming darker or thinner from one to the other ends in the development roller axial direction. The density also fluctuates when a gap between a doctor blade, which adjusts a thickness of a layer of developer on a surface of a development roller, and the development roller fluctuates.

For example, when the density fluctuates in the main scanning direction and a smaller amount of toner particles is adhered to the left end in FIG. 4 opposing the optical sensor 31*a* and a greater amount of toner particles is adhered to the right end opposing the optical sensor 31*s*, a Magenta color gradation pattern Pm becomes thinner over the entire gradation.

On the other hand, when the density fluctuates in the main scanning direction and the amount of adhered toner particles at the position of the optical sensor 31*a* at the left end in FIG. 4 is greater than the other sections, the Magenta color gradation pattern Pm becomes darker over the entire gradation.

Accordingly, when such gradation patterns are detected and the above described feedback control is executed based on the amount of adhered toner particles, although the amount of adhered toner particles increases at the left end, and accordingly that of adhered toner particles is adjusted to the target value at each of positions directly below the optical sensor 31*a*, the amount of adhered toner particles increases over the entire image as a whole in the former situation. By contrast, in the latter situation, the amount of adhered toner particles decreases as a whole.

Figure 5:
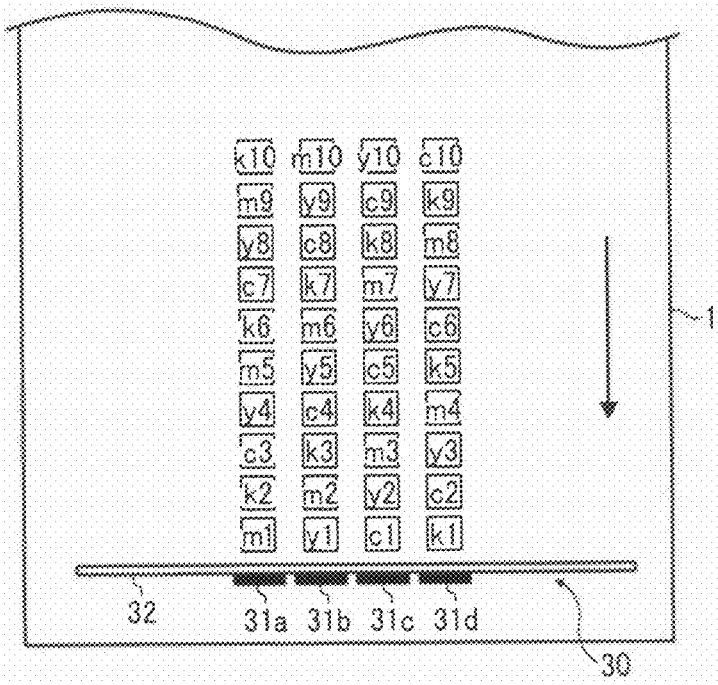
FIG. 5 is a schematic view showing an intermediate transfer belt in an image forming apparatus according to the present embodiment and a gradation pattern of each color formed on the surface of the intermediate transfer belt.

According to one embodiment of the present invention, the gradation patterns of each color is formed in the image forming apparatus as shown in FIG. 5. Specifically, multiple toner patches forming a gradation pattern of each color are formed being offset in the main scanning direction at the positions of the intermediate transfer belt 1 of the image bearer corresponding to the arrangement positions of respective optical sensors. That is, the first toner patches (e.g. toner patches having the least amount of adhered toner particles) m1, y1, c1, and k1 in the gradation pattern of each color are formed in order of M, Y, C, and K colors from the left side. The second toner patch of each color is formed at a position to be detected by an optical sensor arranged on the right side of the optical sensor which detects the first toner patch, such that the second toner patch for Magenta m2 is formed at the position to be detected by the neighboring optical sensor 31*c* arranged on the right side of the optical sensor 31*a* which detects the first toner patch m1, for example. As to Black color toner patches, since the first toner patch k1 is located at the right most end to be detected by the optical sensor 31*d*, the second Black color toner patch k2 is formed at the position to be detected by the optical sensor 31*a* at the left most end in FIG. 5.

When focusing on the Magenta color gradation pattern, the first, fifth and ninth toner patches m1, m5, and m9 are formed at the left end of the intermediate transfer belt 10 opposing the optical sensor 31*a*, and the second, sixth and tenth toner patches m2, m6 and m10 are formed at positions opposing the optical sensor 31*b*. The third and seventh toner patches m3 and m7 are formed at positions opposing the optical sensor 31*c* and the fourth and eight toner patches m4 and m8 are formed at positions opposing the optical sensor 31*d*. Thus, the toner patches m1 to m10 in the Magenta color gradation pattern are formed being offset in the main scanning direction. In the gradation patterns of the other colors, as is clear from FIG. 5, the toner patches are formed being offset in the main scanning direction similar to the Magenta color gradation pattern.

Thus, since the patches of the gradation pattern of each color are formed being offset in the main scanning direction in this way, fluctuation in the density in the main scanning direction can be averaged as described below in more detail.

That is, when the density fluctuates in the main scanning direction such that a smaller amount of toner particles adheres to the left end opposing the optical sensor 31*a* and a greater amount thereof adheres to the right end opposing the optical sensor 31*d*, although the amounts of adhered toner particles of the first, fifth and ninth toner patches decrease due to the impact of fluctuation in the density in the main scanning direction, the amount of adhered toner particles of the fourth and eight toner patches increases due to the impact in the Magenta color gradation pattern. Thus, since toner patches having less and greater amount of adhered toner particles formed due to the fluctuation in the density in the main scanning direction in a gradation pattern are used and are averaged when the function (y=ax+b) indicating a linear graph is to be calculated based on the average and the developing potentials used when the toner patches are formed. As a result, impact of fluctuation in the density in the main scanning direction can be reduced in comparison with a situation where multiple toner patches of each gradation pattern are detected by one optical sensor.

Now, several modifications are described herein below.

Figure 6:
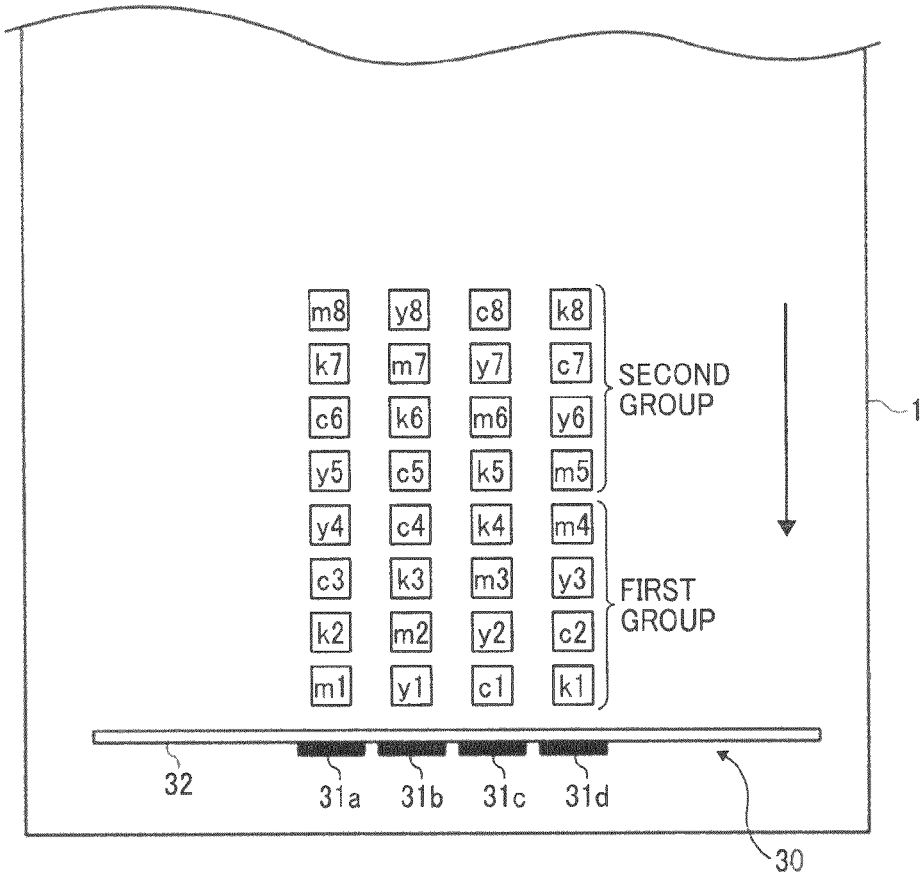
FIG. 6 is a schematic view showing an intermediate transfer belt in an image forming apparatus according to first modification and a gradation pattern of each color formed on the surface of the intermediate transfer belt.

FIG. 6 shows an intermediate transfer belt in an image forming apparatus according to a first modification and a gradation pattern of each color formed on the surface of the intermediate transfer belt. As shown, the gradation pattern of each color is formed satisfying the following conditions.

First, the number of toner patches in a gradation pattern is an even-number multiple of that of optical sensors.

Second, multiple toner patches are divided by a number of adhered toner particles amount detector from the side of a small amount adhered toner particles so that each of these divided toner patches is detected by a different optical sensor in a group.

Third, in an odd-number-order toner patch group when counted from the side of a small amount adhered toner particles among the divided toner patch groups, an amount of toner particles adhered to the toner patches increases from one side toward the other side in the main scanning direction.

Fourth, in an even-number-order toner patch group when counted from the side of a small amount adhered toner particles among the divided toner patch groups, an amount of toner adhered to the toner patches increases from the other side toward the one side in the main scanning direction.

Specifically, by satisfying the above-described conditions, the impact of fluctuation in the density in the main scanning direction can be further reduced as described below in detail with reference to FIGS. 7 to 10.

Figure 7A:
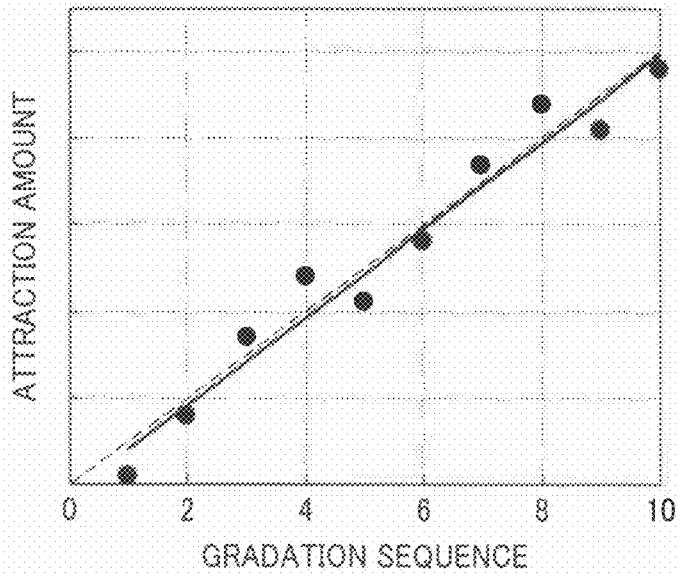
FIGS. 7A and 7B show the relation between a gradation of Magenta toner patches of an Magenta color when the gradation pattern of each color is formed as shown in FIG. 5, and the amount of adhered toner.
Figure 7B:
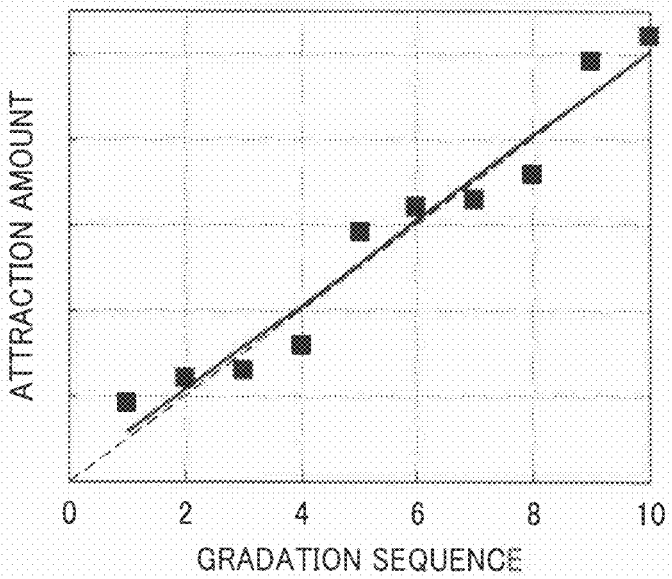

FIGS. 7A and 7B are views each showing a relation between a gradation of toner patches of a Magenta color and amounts of toner particles adhered thereto when the gradation pattern of each color is formed as shown in FIG. 5.

Specifically, FIG. 7A shows a relation between the gradation of toner patches and the amount of toner particles adhered thereto when the density is assumed to fluctuate in the main scanning direction such that it is thinner than the reference on the optical sensor 31*a* side and is darker than the reference on the optical sensor 31*d* side. Whereas FIG. 7B shows a relation between a gradation of toner patches and amounts of toner particles adhered thereto when density is assumed to fluctuate in the main scanning direction such that it is darker on the optical sensor 31*a* side than the reference and is thinner on the optical sensor 31*d* side than the reference. Finely dotted lines in FIG. 7A and FIG. 7B each indicates a relation between a gradation of toner patches and amounts of toner particles adhered thereto when the density does not fluctuate in the main scanning direction. Further, a simulation is performed assuming that a collinear approximation expression (y=ax+b) is (y=x).

As shown in FIG. 7A, since the next toner patch is formed on the right side of a previous toner patch as shown in FIG. 5, the inclinations of the patches (m1 to m4 and m5 to m8) are steeper than the inclination indicated by the dotted line in FIG. 7A. Whereas in FIG. 7B, the inclinations of patches (m1 to m4 and m5 to m8) are more moderate than that of the dotted line in FIG. 7B. Thus, when the gradation pattern of each color is formed by offsetting the toner patches from the left to the right side to oppose the optical sensor of the right side end, and forming the next toner patch opposing the optical sensor of the left end in FIG. 5, sharp and moderate inclinations repeat plural times. Accordingly, it is understood that the collinear approximation expression (y=ax+b) (y=x, in this simulation as shown by a dotted line in FIG. 7) differs from the original one due to the fluctuation in the density in the main scanning direction.

In the embodiment of FIG. 5, since the optical sensors 31*a* and 31*b* on the left side detect a more number of toner patches of the Magenta color gradation pattern than the optical sensors 31*c* and 31*d* arranged on the right side do, the collinear approximation expression is assumed to differ from the original collinear approximation expression (y=ax+b) (i.e., y=x).

Figure 8:
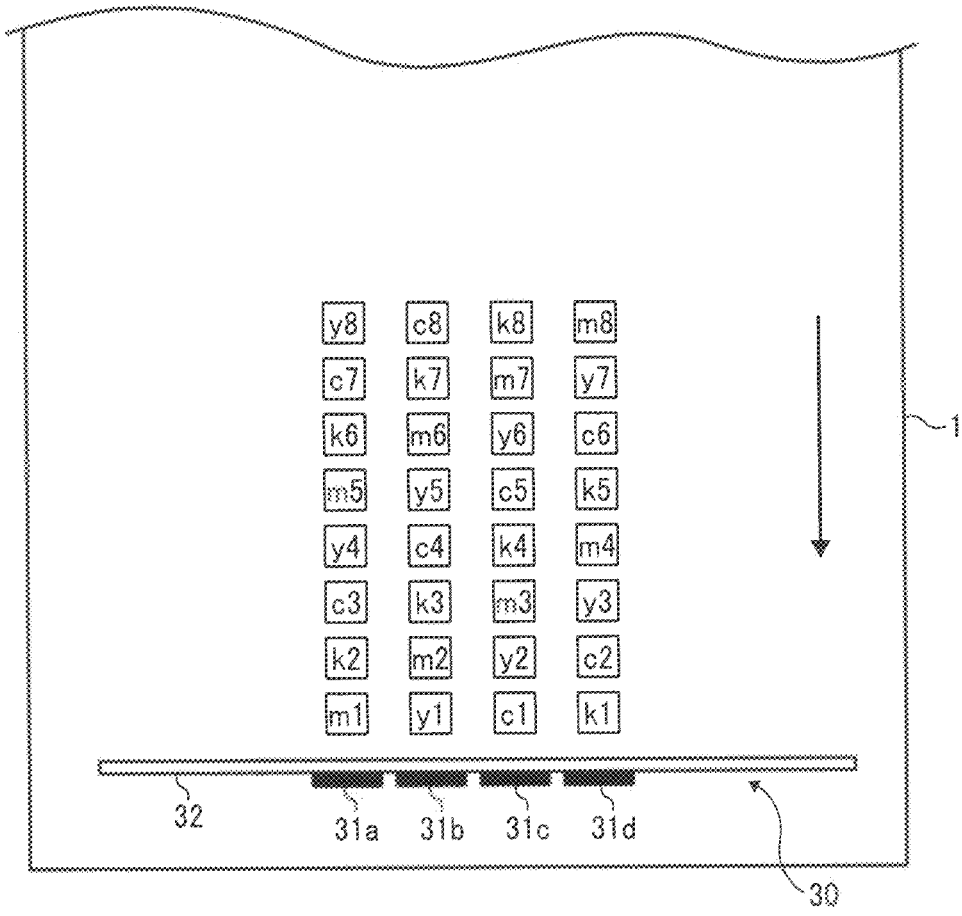
FIG. 8 is a schematic view showing a gradation pattern of each color formed on the surface of an intermediate transfer belt such that the number of toner patches of the gradation pattern of each color detected by each optical sensor becomes the same.
Figure 9A:
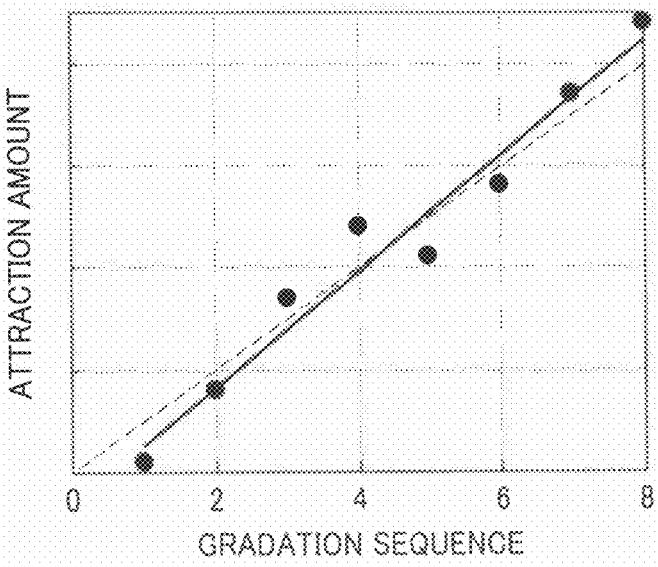
FIGS. 9A and 9B show the relation between a gradation of Magenta toner patches of an Magenta color when the gradation pattern of each color is formed as shown in FIG. 8, and the amount of adhered toner.
Figure 9B:
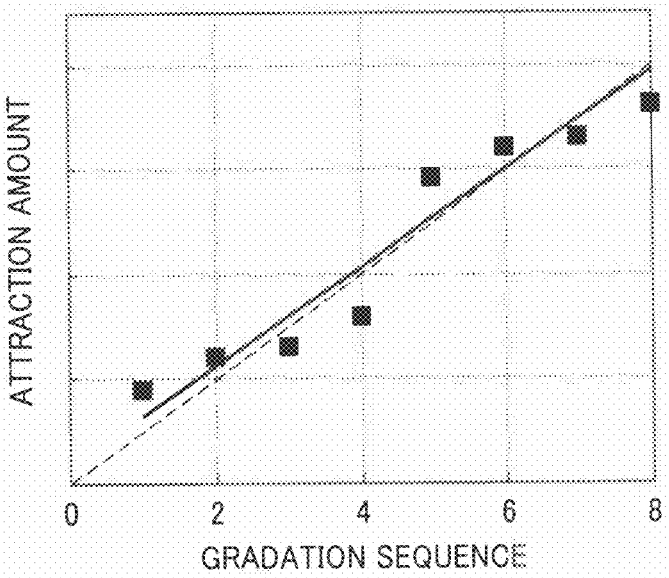

Then, as shown in FIG. 8, eight toner patches are employed in a gradation pattern for each color and the same number of toner patches can be detected by each optical sensor and to perform the above-described simulation as shown in FIGS. 9A and 9B.

Specifically, FIG. 9A illustrates a relation between a gradation of toner patches and amounts of toner particles adhered thereto when density is assumed to fluctuate in the main scanning direction such that it is thinner on the optical sensor 31*a* side than the reference and is darker than the reference on the optical sensor 31*d* side. Whereas FIG. 9B shows a relation between a gradation of toner patches and amounts of toner particles adhered thereto when density is assumed to fluctuate in the main scanning direction such that it is darker than the reference on the optical sensor 31*a* side and is thinner than the reference on the optical sensor 31*d* side.

As shown in FIG. 9, even if the same number of toner patches are detected by each optical sensor, the collinear approximation expression (y=ax+b) (y=x in this simulation) remains a difference from the original one. Moreover, with the gradation pattern of FIG. 8, the collinear approximation expression more significantly deviates from the original one in comparison with a situation where the gradation pattern is formed as shown in FIG. 5. This is supposedly because the number of items of data decreases, thereby increasing the deviation. Accordingly, even if the same number of toner patches are detected by each optical sensor, the impact of fluctuation in the density in the main scanning direction cannot sufficiently be removed.

Figure 10A:
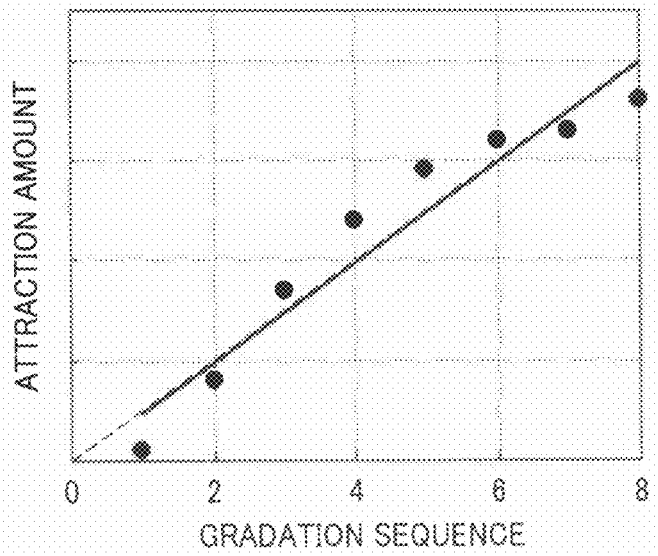
FIG. 10 is a view showing the relation between a gradation of toner patches of an Magenta color when the gradation pattern of each color is formed as shown in FIG. 6, and the amount of adhered toner.
Figure 10B:
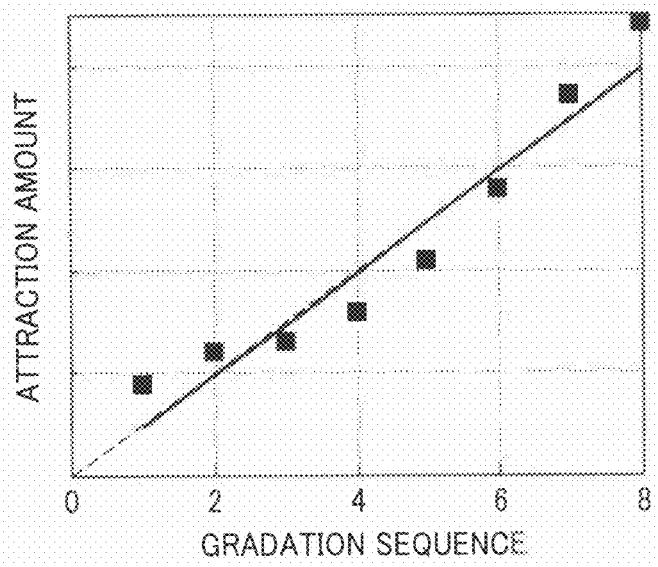

FIGS. 10A and 10B each shows a simulation result executed using a gradation pattern formed in the first modification shown in FIG. 6. Specifically, FIG. 10A shows a relation between a gradation of toner patches and amounts of toner adhered thereto when density is assumed to fluctuate in the main scanning direction such that it is thinner than the reference on the optical sensor 31*a* side and is darker than the reference on the optical sensor 31*d* side. Whereas FIG. 10B shows a relation between a gradation of toner patches and amounts of toner adhered thereto when density is assumed to fluctuate in the in the main scanning direction such that it is darker on the optical sensor 31*a* side than the reference and is thinner than the reference on the optical sensor 31*d* side.

As understood from these drawings, the gradation pattern of first modification formed by satisfying the above described first to fourth conditions can provide a collinear approximation expression nearly equivalent to the original collinear approximation expression (y=ax+b) (y=x). Specifically, as shown in FIG. 10A, when the density fluctuates in the main scanning direction such that it is thinner on the optical sensor 31*a* side than the reference and is darker than the reference on the optical sensor 31*d* side, the inclination of the toner patches (m1 to m4) in the first group of the odd-number-order toner patch group is steeper than the inclination shown by the dotted line in FIG. 10A, and the inclination of the toner patches (m5 to m8) of the second group of the even-number-order toner patch group are is moderate than the inclination shown by the dotted line in FIG. 10A.

By contrast, as shown in FIG. 10B, when fluctuation in the density in the main scanning direction is contrary to the situation of FIG. 10A, the inclinations (m1 to m4) of the first group of the odd-number-order toner patch group are more moderate than the inclination shown by the dotted line in FIG. 10B, and the inclinations of the toner patches (m5 to m8) of the second group of the even-number-order toner patch group are steeper than the inclination shown by the dotted line in FIG. 10B.

As described in first modification, when toner patches formed in the odd-number-order (first) toner patch group, when counted from the side of a small amount adhered toner particles, among toner patch groups divided by a number of optical sensors is offset from the left to the right in the main scanning direction, and that in the even-number-order (second) toner patch group is offset from the right to the left in the main scanning direction, sharp and moderate inclinations appear alternately. That is, by offsetting the positions to form the toner patches in the main scanning direction, density tends to gradually become darker or thinner.

As a result, weighting can equally be put onto fluctuation in the density in the main scanning direction, so that the approximation straight line becomes substantially the original one. Especially, since the position to form the next toner patch in the main scanning direction is not significantly shifted as being from the leftmost to the rightmost or vice a versa in the Magenta color gradation pattern, continuity of data can be obtained and the approximation straight line substantially as same as the original one can be more readily obtained.

As described in first modification,

Specifically, by forming and offsetting toner patches from the left to the right in the main scanning direction in the odd-number-order (first) toner patch group, when counted from the side of a small amount adhered toner particles, among toner patch groups divided by a number of optical sensors, while forming and offsetting toner patches from the right to the left in the main scanning direction in the even-number-order (second) toner patch group, approximation straight line data which can substantially cancel the impact can be obtained, even if the density fluctuates in the main scanning direction.

Consequently, when the amount of adhered toner particles is controlled based on the inclination (γ value) of an approximation straight line, and if the pattern is formed as shown in FIG. 6, image density control of each color can be stabilized while reducing the impact of fluctuation in the density in the main scanning direction, even if the density fluctuated in the main scanning direction.

Further, color of the last toner patch in the main scanning direction of a patch group and that of the first toner patch in the main scanning direction of the next patch group are the same in the pattern as shown in FIG. 6.

Figure 11:
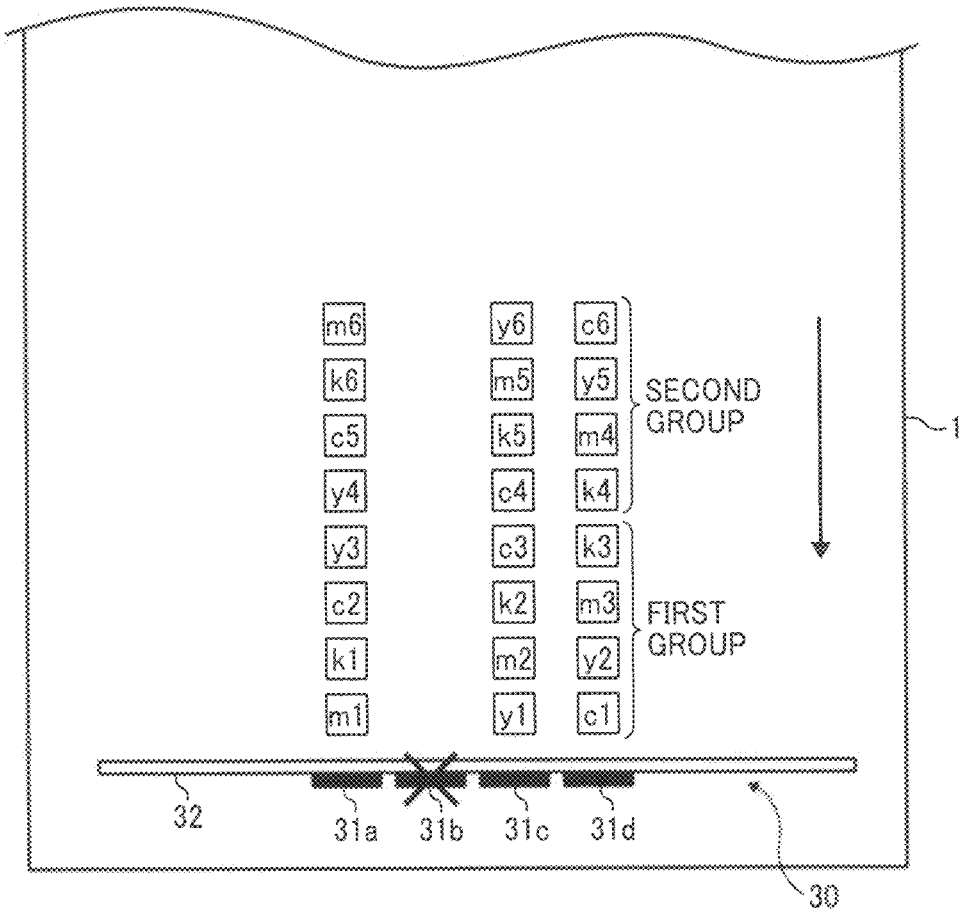
FIG. 11 is a schematic view showing an intermediate transfer belt in an image forming apparatus according to second modification and a gradation pattern of each color formed on the surface of the intermediate transfer belt.

Now, a second modification is described with reference to FIG. 11, in which an intermediate transfer belt in an image forming apparatus and a gradation pattern of each color formed on the surface of the intermediate transfer belt are schematically illustrated.

A number of toner patches of the gradation pattern of each color and distribution of each toner patch in the main scanning direction are determined according to the number of optical sensors used in image density control. When the second optical sensor 31*b*, when counted from the leftmost in FIG. 11, is broken, and the number of optical sensors used in image density control decreases from four to three, the controlling unit reconstructs the number and distribution of the toner patches in the gradation pattern of each color based on the number of optical sensors to be used.

In this modification, the number of toner patches of each color gradation pattern is six (e.g. a multiple of the number of optical sensors of 3 and even number of 2) under the first condition shown in the above described modification. Further, when multiple toner patches are divided by the number of adhered toner amount detector from the side of a small amount adhered toner particles in the first toner patch group, the toner patches are formed in order of m, y, c and k colors from the left to the right. Whereas in the second toner patch group, the toner patches are formed in order of k, c, y and m from the right to the left. Thus, a pattern configuration is reconstructed according to the number of optical sensors, so that image density can be adjusted without fixing the broken optical sensor. Further, instead of the six toner patches, the number of toner patches may be twelve (e.g. a multiple of the number of optical sensors: 3 and even number: 4) to improve control precision upon need . . . .

Thus, a pattern is reconstructed to satisfy the first to fourth conditions described in the first modification, image density can be stably controlled for each color while reducing the impact of fluctuation in the density in the main scanning direction, even if density fluctuates in the main scanning direction.

As described above, the image forming apparatus has: image forming stations 40Y, 40M, 40C and 40K of image forming device for forming a toner image on the intermediate transfer belt 1 of an image bearer; the optical sensor 31 of adhered toner amount detector for detecting the amount of adhered toner particles of the toner image on the intermediate transfer belt 1; and the controller 200 of image density adjusting device for forming a gradation pattern formed including multiple toner patches formed under image forming conditions where the amount of adhered toner particles is different from each other, and adjusting the image forming conditions based on the detected values obtained by detecting multiple toner patches by the optical sensors.

Further, with the image forming apparatus according to the present embodiment, multiple optical sensors are arranged in the main scanning direction, and the controller 200 scatters and forms toner patches of the above gradation pattern in each section corresponding to the arrangement position of each optical sensor of the intermediate transfer belt 1 in the main scanning direction. Thus, by forming the toner patches of the gradation pattern, it is possible to prevent the fluctuation in the density in the main scanning direction from influencing image density control, and perform precise image density control.

Particularly, the adhered toner amount detector are arranged symmetrically across the center of the image bearer in the main scanning direction, so that, when the density fluctuates in the main scanning direction where the density on one side in the main scanning direction is darker and becomes thinner toward the other side, it is possible to detect toner patches having an increased amount of adhered toner particles and toner patches having a reduced amount of adhered toner particles due to the impact of fluctuation in the density in the main scanning direction. By this device, it is possible to reduce the impact of fluctuation in the density in the main scanning direction compared to a situation where optical sensors are concentrated and arranged on one side in the main scanning direction.

Particularly, by forming a gradation pattern to satisfy the following first to fourth conditions, it is possible to reduce fluctuation in the density in the main scanning direction. First, the number of toner patches of a gradation pattern as much as an odd-number fold of the number of optical sensors is formed. Second, when multiple toner patches are divided by the number of optical sensors from the side of a small amount adhered toner particles, each toner patch of a group of these divided toner patches is formed in a respectively different position on the image bearer in the main scanning direction such that each toner patch is detected by different toner adhered amount detector. Third, the odd-number-order toner patch group from the side of a small amount adhered toner among the divided toner patch group is formed to increase the amount of adhered toner particles of toner patches from one side toward the other side in the main scanning direction. Fourth, the above gradation pattern is formed such that the even-number-order toner patch group from the side of a small amount adhered toner among the divided toner patch group is formed to increase the amount of adhered toner particles of toner patches from the other side toward the one side in the main scanning direction. When the above-described second to fourth conditions are satisfied, the amount of toner particles adhered to the patches increases in one toner patch group when the gradation increases due to the impact of fluctuation in the density in the main scanning direction, and the amount of adhered toner particles to toner patches decreases in the other toner patch group when the gradation increases due to the impact of fluctuation in the density in the main scanning direction. Further, by satisfying the above-described first condition, it is possible to provide the same number of the above trends where the amount of adhered toner particles increases and the trends where the amount of adhered toner particles decreases. By this device, it is possible to assign weighting on average to the directionality of fluctuation in the density in the main scanning direction, and, no matter how the density fluctuates in the main scanning direction; it is possible to obtain approximation straight line data which can substantially cancel the impact.

Further, the controller 200 determines the number of toner patches of the gradation pattern and distribution of each toner patch in the main scanning direction based on the number of optical sensors used in image density control and, consequently, can perform image density adjustment even if one of the optical sensors is broken. Further, in this situation, by reconfiguring the pattern configuration to satisfy the above-described first to fourth conditions, it is possible to continuously provide the above-described effect.

Numerous additional modifications and variations of the present invention are possible in latent image of the above-described teachings. It is therefore to be understood that within the scope of the appended claims, the present invention may be practiced otherwise that as specifically described herein.

What is claimed is:

1. An image forming apparatus comprising:

an image bearer to bear an image;

an image formation device to form a toner image on the image bearer;

at least two toner adhered amount detectors, aligned in a main scanning direction of the image forming apparatus above the image bearer, to detect an amount of toner particles adhered to the toner image on the image bearer; and an image density controller to form at least one gradation pattern including at least two toner patches, staggered at different positions on the image bearer, facing the at least two toner adhered amount detectors, and sequentially arranged in a sub-scanning direction of the image forming apparatus on the image bearer from the least toner adhered amount patch bearing a different amount of toner particles from each other, said image density controller adjusting an image formation condition for the image formation device based on detection values of the at least two toner patches detected by the at least two toner adhered amount detectors, wherein one of the at least two toner adhered amount detectors detects a toner patch of one color at a same time that another of the at least two toner adhered amount detectors detects a toner patch of another color.

2. The image forming apparatus as claimed in claim 1, wherein said at least two toner adhered amount detectors are optical detectors.

3. The image forming apparatus as claimed in claim 1, wherein a total number of said at least two toner patches is a prescribed even number multiple of a number of said at least two toner adhered amount detectors, wherein said image density controller divides the total number of the toner patches into at least two groups each having prescribed multiple numbers of toner patches obtained by multiplying the number of the at least two toner adhered amount detectors by a prescribed number, and wherein said at least two toner patches are sequentially arranged at different positions in both the main and sub-scanning directions being staggered having a first inclination in an odd number group, said at least two toner patches facing the respective of said at least two toner adhered amount detectors, and wherein said at least two toner patches are sequentially arranged at different positions in both the main and sub-scanning directions and staggered having a second inclination in the next even number group, said second inclination being symmetric with the first inclination, said at least two toner patches facing the respective of said at least two toner adhered amount detectors.

4. The image forming apparatus as claimed in claim 3, wherein said odd and even number groups are sequentially formed in the sub-scanning direction, and wherein the end of the first inclination corresponds to the start of the second inclination.

5. The image forming apparatus as claimed in claim 3, wherein said toner particles are increasingly adhered to the at least two toner patches in the even and odd number groups in both the main and sub-scanning directions.

6. The image forming apparatus as claimed in claim 3, wherein said image density controller determines the total number of toner patches, and a manner of staggering of the at least two toner patches in the main and sub-scanning directions based on the number of the at least two toner adhered amount detectors.

7. The image forming apparatus as claimed in claim 6, wherein said image density controller changes the manner of staggering of the at least two toner patches when one of the at least two toner adhered amount detectors becomes inoperable.

8. The image forming apparatus as claimed in claim 1, wherein said at least two toner adhered amount detectors are symmetrically aligned in a main scanning direction of the image forming apparatus.

9. A method of forming an image on an image bearer in an image forming apparatus, comprising the steps of:

forming at least one gradation pattern as a test toner image on an image bearer including at least two toner patches, staggered at different positions on the image bearer, facing at least two toner adhered amount detectors aligned in a sub-scanning direction of the image forming apparatus, and sequentially arranged in a sub-scanning direction on the image bearer from the least toner adhered amount patch bearing a different amount of toner particles from each other;

detecting an amount of toner particles adhered to the test toner image on the image bearer using the at least two toner adhered amount detectors;

adjusting an image formation condition for an image formation device based on detection values of the at least two toner patches detected by the at least two toner adhered amount detectors; and forming a toner image on the image bearer using the image formation device based on the image formation condition adjusted, wherein the detecting detects a toner patch of one color, using one of the at least two toner adhered amount detectors, at a same time that the detecting detects a toner patch of another color, using another of the at least two toner adhered amount detectors.

* * * * *